United States Patent [19]

McLennan

[11] 4,256,338

[45] Mar. 17, 1981

[54] ANTI-SNAG HOOK

[76] Inventor: Richard E. McLennan, 27019 Grayslake Rd., Rancho Palos Verdes, Calif. 93013

[21] Appl. No.: 64,043

[22] Filed: Aug. 6, 1979

[51] Int. Cl.[3] ..... B66C 1/34; A44B 1/18

[52] U.S. Cl. ..... 294/82 R; 24/230.5 TP

[58] Field of Search ..... 294/82 R, 78 R, 74; 24/230.5 R, 230.5 TP, 241 R; 59/78, 85, 93

[56] References Cited

U.S. PATENT DOCUMENTS

| | | | |
|---|---|---|---|
| 1,702,946 | 2/1929 | Powers et al. | 24/230.5 TP |
| 1,959,985 | 5/1934 | Moll | 294/82 R |
| 3,879,812 | 4/1975 | Clinch | 24/230.5 TP |

*Primary Examiner*—James B. Marbert

*Attorney, Agent, or Firm*—Smyth, Pavitt, Siegemund & Martella

[57] ABSTRACT

A hook secured to the end of a rope for attaching that rope to a rod, a staple, or another rope includes the usual parts such as a shank portion by which the hook is pulled in a longitudinal direction, a reverse portion extending in the direction of pulling and terminating in a tip, and a mid portion extending laterally to one side of the reverse portion and connecting the shank and the reverse portion, and in accordance with the present invention the hook further includes a novel protrusion extending from the shank portion or from the mid portion, the protrusion being spaced from the reverse portion and extending longitudinally in a direction opposite the direction of pulling and terminating in an end portion located laterally on the opposite side of the reverse portion from the mid portion.

4 Claims, 2 Drawing Figures

ANTI-SNAG HOOK

BACKGROUND OF THE INVENTION

The present invention relates to a type of hook widely used in the air cargo industry, although the invention is not limited to use in that field. Typically, the hook is secured to the end of a rope or cable to provide a convenient way of connecting the rope or cable to another rope or to a structural member such as a rod or a staple. Sometimes the hooks are placed at various locations on cargo nets to provide means whereby the net may be tensioned down tightly over and around the cargo. A typical hook of this type, known in the art, is shown in FIG. 1.

The end of the hook to which the rope is secured will be referred to below as the shank portion 12 of the hook. The hook is bent back upon itself so as to have a reverse portion 14 at the opposite end, and the reverse portion terminates in a tip 16. A mid portion 18 connects the shank 12 with the reverse portion 14 and the mid portion 18 extends laterally to one side of the reverse portion. Typically, the hook is a unitary structure made of flat-stock steel or aluminum.

The hooks above, typified by that shown in FIG. 1, suffer from a major disadvantage when used in proximity to cargo nets. Prior to use, the cargo net may be bundled up and carried to the location of use, where the net is then laid out on the ground or thrown over some cargo. However, it is frequently found that the hooks have become caught on part of the net and must be unhooked before the net can be unfurled for use. Unhooking the snagged hook is a frustrating and time-consuming process because as the net is moved about to free certain hooks, some of the hooks already freed will again become snagged.

This problem, common to hooks of the prior art, is greatly alleviated by the design of the hook of the present invention.

One could, conceivably, provide a pivotable quard member which would normally cover the entrance of the space between the reverse portion and the remainder of the hook, but which could be pivoted away from the entrance to permit a rope to pass into the space. Such a hook has several disadvantages. It has several parts which must be assembled. It is more complicated to operate. Probably the most serious objection is that the device would not be sufficiently sturdy to survive without damage being run over by a loaded fork lift, as frequently happens in cargo-handling operations.

SUMMARY OF THE INVENTION

The first step in solving the snagging problem was to recognize that the snagging was caused by the fact that in the prior art hooks, the space between the reverse portion of the hook and the remainder of the hook opens in the direction in which the hook is being pulled, so that as the hook is pulled over a net, some of the ropes of the net are drawn into the opening, thereby snagging the hook.

In contrast, in the present invention, the space between the reverse portion of the hook and the remainder of the hook is shaped to open in a direction opposite the direction in which the hook is being pulled. In a preferred embodiment, the improved shape of the space between the reverse portion and the remainder of the hook is achieved by the provision of a protrusion which extends laterally from the shank portion or from the mid portion of the hook to a location laterally beyond the tip of the reverse portion to form a shield or guard to prevent the ropes of a net from becoming engaged in the opening as the hook is drawn across the ropes.

In one embodiment of the invention, a second protrusion extends laterally from the reverse portion of the hook on the side of the reverse portion away from the mid portion, and this second protrusion also tends to shield the opening from inadvertent entry of a rope.

In the present invention, for a rope to enter the hook, the rope must overtake the hook as the hook is pulled and the rope must then reverse its direction to become engaged with the hook. This action is extremely unlikely to occur in practice, which accounts for the effectiveness of the present invention.

The novel features which are believed to be characteristic of the invention, together with further objects and advantages of it, will be better understood from the following description considered in connection with the accompanying drawings, in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
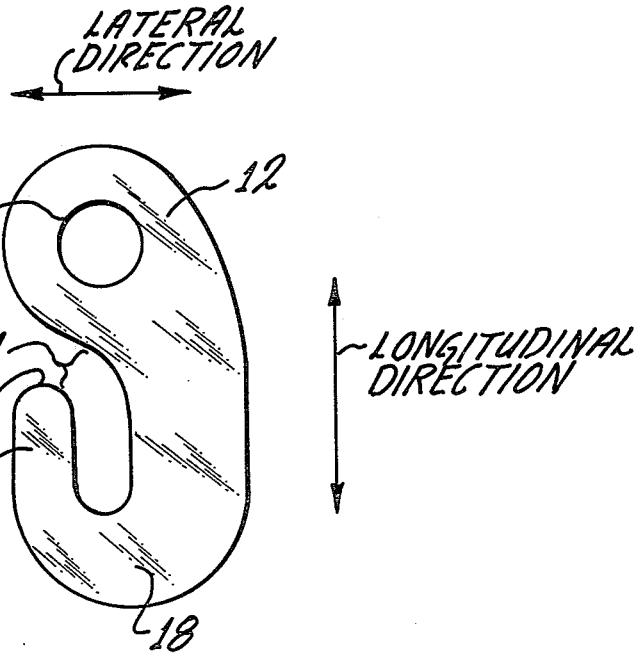
FIG. 1 (PRIOR ART)
FIG. 1 is a plan view of a prior art hook.
Figure 2:
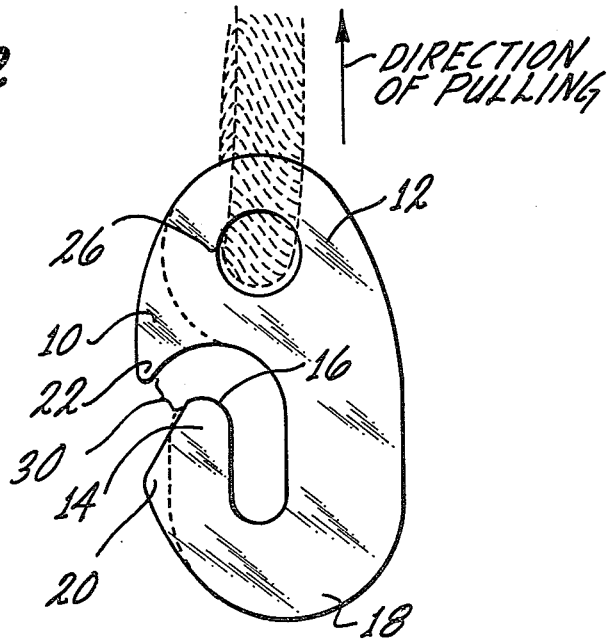
FIG. 2 is a plan view showing a hook according to the preferred embodiment of the present invention.

Like the hook of the prior art shown in FIG. 1, the hook in a preferred embodiment of the present invention includes a shank portion 12 at one end, a reverse portion 14 terminating in a tip 16 and includes a mid portion 18, as shown in FIG. 2. The salient differences between the hook of the present invention and the prior art hook shown in FIG. 1 can best be seen by superimposing the outline of the hook of FIG. 1 onto FIG. 2, as indicated by the dashed lines in FIG. 2. In this manner, it can be seen that the hook of the present invention is distinguished by the protrusion 10 extending from the shank portion 12 and spaced from the reverse portion 14. The protrusion 10 extends longitudinally in a direction opposite the direction of pulling and the protrusion 10 terminates in an end portion 22 that is located laterally on the opposite side of the reverse portion from the mid portion.

In another embodiment of the present invention, the end portion 22 extends longitudinally in a direction opposite the direction of pulling beyond the tip 16 of the reverse portion 14.

In the preferred embodiment shown in FIG. 2, a protrusion 20 extends laterally from the reverse portion 14 on the side of the reverse portion away from the mid portion.

Comparing FIG. 1 with FIG. 2, it is seen that in FIG. 1 the space 24 between the reverse portion 14 and mid portion 18 opens generally in the direction the hook is to be pulled, whereas in the embodiment shown in FIG. 2, the space 30 opens in a direction opposite the direction of pulling. In the embodiment in FIG. 2, the space 24 reverses direction and has the shape generally of an inverted U.

As the hook of FIG. 1 is drawn in the direction of pulling, there will be a tendency for any ropes over which it passes to be drawn into the space 24 by the motion of the hook. In contrast, in the preferred embodiment of FIG. 2, there will be no tendency of the ropes to enter the space 30 as the hoook is pulled in the direction indicated.

As shown in FIG. 1 and 2, a hole 26 in the shank portion 12 of the hook provides a means for securing a rope to the shank portion. In other embodiments, a special fitting may be used to secure the rope to the hook.

Although the protrusion 20 of FIG. 2 is a part of the preferred embodiment, in other embodiments, this feature is omitted.

One of the most attractive features of the preferred embodiment of the present invention is that the entire hook is a unitary structure made from flat-stock steel or aluminum. The resulting hook is exceedingly sturdy, and therefore remains undamaged even when run over by a loaded fork lift during cargo-handling operations. In addition, the hook of the preferred embodiment is economical to manufacture, particularly since it has no parts that need to be assembled.

The hook of the present invention can be attached to a rope, a rod, a staple, or like structure, by a simple one-handed operation. This contrasts with other hooks that have guard portions that must be opened with one hand while the main part of the hook is held in the other hand.

The foregoing detailed description is illustrative of one embodiment of the invention, and it is to be understood that additional embodiments thereof will be obvious to those skilled in the art. The embodiment described herein, together with those additional embodiments are considered to be within the scope of the invention.

What is claimed is:

1. In a hook of the type having at one end a shank portion by which the hook is normally pulled in a longitudinal direction, having at the other end a reverse portion extending in the direction of pulling and terminating in a tip, and having a mid portion extending laterally to one side of the reverse portion and connecting the shank and the reverse portion, the improvement comprising:

a protrusion extending from the shank portion and spaced from the reversed portion, said protrusion extending longitudinally in a direction opposite the direction of pulling and terminating in an end portion located laterally on the opposite side of the reverse portion from the mid portion, said end portion and said tip of said reverse portion defining a space therebetween; and a protrusion extending laterally from the reverse portion on the side of the reverse portion away from the mid portion and terminating in an end portion, whereby said end portion of said protrusion of said shank portion is in alignment with said end portion of said protrusion extending laterally from said reverse portion along an axis parallel to the direction of pulling, such that said space opens generally in the opposite direction that said hook is being pulled.

2. The improvement of claim 1 wherein said end portion extends longitudinally in a direction opposite the direction of pulling beyond the tip of the reverse portion.

3. The improvement of claim 1 wherein the shank portion further comprises means adapted to secure a rope to the shank portion.

4. The improvement of claim 1 wherein the hook is a unitary structure of substantially uniform thickness in a direction perpendicular to the longitudinal and lateral directions.

* * * * *